US005343693A

United States Patent [19]

Komatsu et al.

[11] Patent Number: 5,343,693

[45] Date of Patent: Sep. 6, 1994

[54] COMBUSTOR AND METHOD OF OPERATING THE SAME

[75] Inventors: Yasutaka Komatsu; Michio Kuroda; Yasuhiko Ootawara; Nobuyuki Iizuka; Isao Sato; Masayuki Taniguchi; Noriyuki Hayashi, all of Ibaraki, Japan

[73] Assignee: Hitachi, Ltd., Tokyo, Japan

[21] Appl. No.: 947,828

[22] Filed: Sep. 21, 1992

[30] Foreign Application Priority Data

Sep. 19, 1991 [JP] Japan ..... 3-239979

[51] Int. Cl.[5] ..... F23C 3/00; F23R 3/22

[52] U.S. Cl. ..... 60/39.23; 60/737; 60/749

[58] Field of Search ..... 60/39.23, 737, 738, 60/739, 740, 741, 743, 744, 748, 749

[56] References Cited

U.S. PATENT DOCUMENTS 3,728,859 4/1973 Seiler ..... 60/748
4,078,377 3/1978 Owens et al. ..... 60/749
4,150,539 4/1979 Rubins et al. ..... 60/749
4,171,612 10/1979 Zwick ..... 60/749
4,199,934 4/1980 Meyer ..... 60/737
4,202,934 5/1980 Meyer ..... 60/749
5,081,843 1/1992 Ishibashi et al. ..... 60/733

FOREIGN PATENT DOCUMENTS 0240833 11/1985 Japan ..... 60/733

*Primary Examiner*—Richard A. Bertsch
*Assistant Examiner*—Timothy S. Thorpe
*Attorney, Agent, or Firm*—Antonelli, Terry, Stout & Kraus

[57] ABSTRACT

A combustor comprises a passage area changing mechanism which relatively moves a flame holder relative to a premixed combustion nozzle in an axial direction so that the area of passage for premixed gas between an injection edge of the premixed combustion nozzle and a peripheral edge of the flame holder can be changed. Stable combustion can be maintained over a wide load range and reduction in NOx can be achieved.

5 Claims, 11 Drawing Sheets

FUEL INSTRUCTION SIGNAL
FUEL PIPE
FLAME HOLDER POSITION PRESETTING UNIT
ACTUATION SHAFT DRIVE MECHANISM
10
15
16
17
18
19
21
22
23
25
31
32
50
55
Ga
Ga
1
5
5
1
6
8
8

COMBUSTOR AND METHOD OF OPERATING THE SAME

BACKGROUND OF THE INVENTION

1. Field of the Invention

The present invention relates to a combustor and a method of operating the same and in particular to a combustor in which a flame holder which forms a circulating flow of a combusted gas downstream of the flame holder for enhancing the stability of a premixed flame is provided in the vicinity of an exit of a premixed combustion nozzle.

2. Prior Art

A double combustion method using diffusion and premixed combustion has predominantly been adapted as a low NOx combustion technology for gas turbines.

The premixed combustion aims at reducing NOx by supplying fuel and rich air to a premixing chamber to perform low temperature combustion with lean premixed gas.

The premixed combustion is controlled to provide a substantially constant fuel/air ratio even if the load fluctuates, since the combustion characteristics largely depend upon the mixing ratio of the fuel to the air (fuel-/air ratio). Accordingly, if the output of a gas turbine is lowered, the flow rate of the air is also throttled with the decrease in the flow rate of the fuel. As a result of this, the flow rate of the premixed gas is decreased.

If the flow speed of the premixed gas is lowered below a given limit, a backfire phenomenon in which a flame counterflows in an upstream direction may occur, resulting in damage to a premixed combustion nozzle by the backfire. Conversely, if the flow speed becomes excessively high, blowing out of the flame may occur, resulting in total lack of operation. Accordingly, in order to constantly operate a combustor, it is necessary to cause the flow speed of the premixed gas to fall over a wide load range i.e. flow rate. Therefore, the area of a passage has conventionally been changed to respond to the load by moving an inner cone-shaped wall of a double cone-shaped wall including inner and outer walls which form an annular premixed gas passage as described in, for example, Japanese Unexamined Utility Model Publication (KOKAI) No. Sho 63-97019.

However, the premixed flame is constantly directed inwardly since the premixed gas passage comprises a double cone-shaped wall in the prior art. A diffusion flame from a pilot burner which is provided centrally of the annular premixed gas passage constantly interferes with the premixed flame at a certain ratio.

Although it is hard to stably maintain a flame with the premixed gas since the premixed gas contains lean fuel and has a narrow combustible range, the premixed air has an advantage in that stabilization of the premixed flame is achieved by creating an interference of the premixed flame with the stable diffusion flame. If the premixed flame is caused to interfere with the diffusion flame, the combustion temperature is elevated by the influence of the diffusion flame, so that NOx in the exhaust gas can not be reduced although the premixed gas is burnt with the intention of reducing NOx.

Since the area of the passage is throttled over the premixed gas passage in the prior art, pressure loss becomes high, resulting in an increase in the load imposed upon a compressor for supplying pressurized air to a combustor.

It is, therefore, an object of the present invention to provide a combustor in which stable combustion can be maintained over a wide load range and NOx can be reduced, a method operating the same and a gas turbine system including the same combustor.

A combustor in which a flame holder is moved is disclosed in Japanese Unexamined Patent Publication (KOKAI) No. Hei 1-189407. The combustor responds to the change in fuel, etc. by changing the flow rate of a circulating flow formed downstream of a flame holder and is not capable of maintaining the fuel flow at a constant speed.

SUMMARY OF THE INVENTION

In order to accomplish the above mentioned object, the present invention provides a combustor in which a flame holder which forms a circulating flow of a combusted gas downstream of the flame holder for enhancing the stability of a premixed flame is provided in the vicinity of an output of a premixed combustion nozzle which comprises a passage area changing mechanism for deforming at least one of the flame holder and the premixed combustion nozzle so that the passage area for a premixed gas between a premixed gas injection slot edge of the premixed combustion nozzle and a peripheral edge of the flame holder can be changed.

It is preferable that the combustor be provided with change control means for instructing to the passage area changing mechanism the amount of deformation or movement of at least one of the flame holder and the premixed combustion nozzle.

A term "combustor" used herein includes any apparatus in which premixed combustion is carried out, such as a gas turbine combustor and a boiler.

If the injection amount of the premixed air is changed with the change in the load imposed upon the combustor, the area of the passage between the injection slot edge of the premixed combustion nozzle and the peripheral edge of the flame holder is correspondingly changed by deforming or relatively moving one of the flame holder and the premixed combustion nozzle relative to the other. Since the area of the passage for the premixed gas at the premixed gas injection slot can be changed in such a manner, the flow speed of the premixed gas can be maintained substantially constant even if the flow rate of the premixed gas flow rate is changed. Accordingly, backfire and blowing out of a flame, etc. can be prevented.

Since the injection direction of the premixed air can be changed by deforming or relatively moving one of the flame holder and the premixed combustion nozzle, the interference of the diffusion flame with the premixed flame can be reduced by changing the injection direction of the premixed gas to change the range of the formed premixed flame when the premixed combustion becomes stable even if the diffusion flame is caused to interfere with the premixed flame only at the time of initial firing. Since stabilization of the premixed flame can be achieved with the flame holder, lean premixed combustion can be carried out. Accordingly, reduction in NOx can be achieved by reducing the interference of the diffusion flame with the premixed flame and by carrying out the lean premixed combustion.

Since only the area of the passage of the premixed gas injection slot is throttled in the present invention unlike combustors in which the area of an entire passage for the premixed gas is throttled, pressure loss can be reduced to thus reduce the load upon an compressor.

DESCRIPTION OF THE EMBODIMENTS

Figure 1:
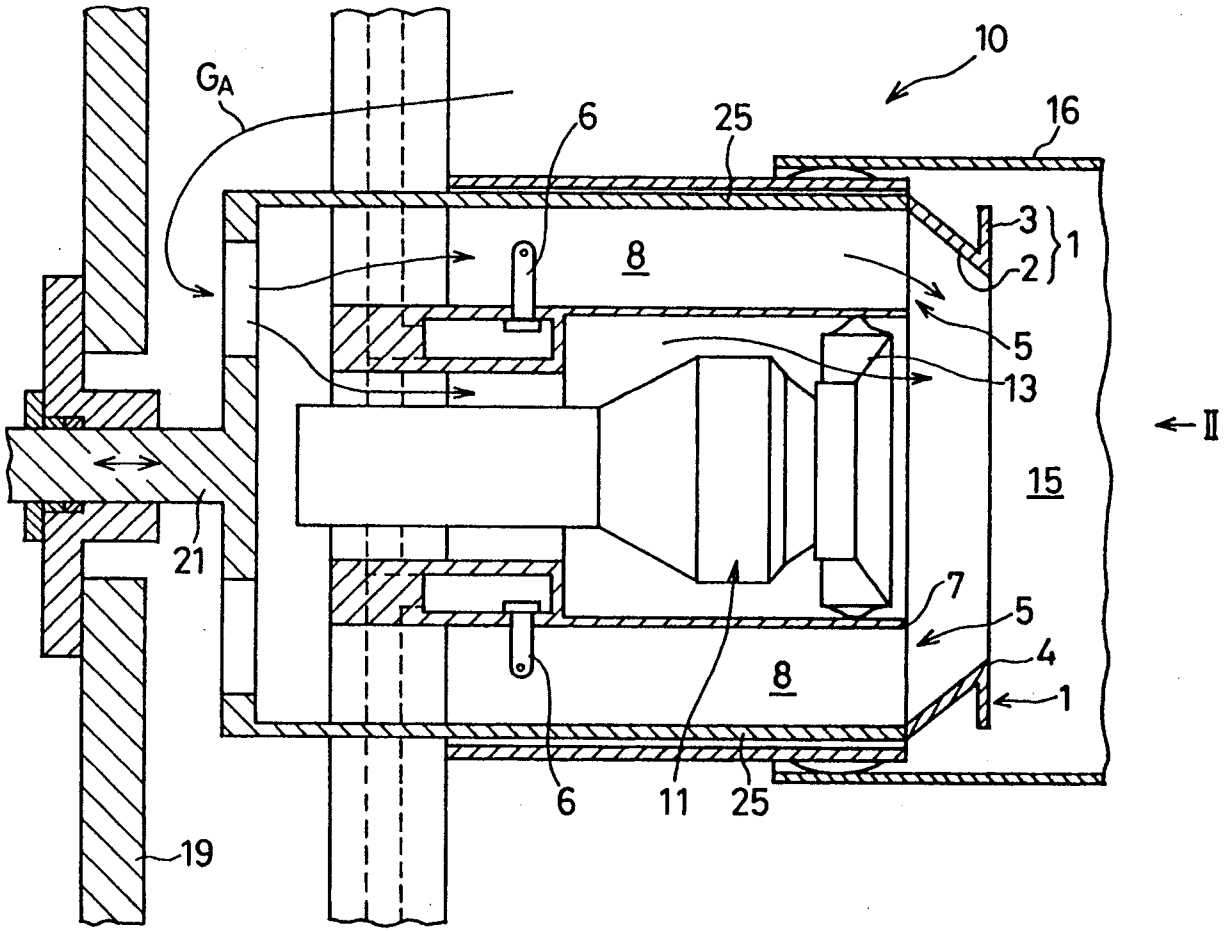
FIG. 1 is a sectional view showing a main part of a first embodiment of a gas turbine combustor of the present invention.

Embodiments of the present invention will be described with reference to FIGS. 1 through 14. Like reference numerals denote like components throughout the drawings. Duplication of description of the like components will be omitted for simplicity of description.

A first embodiment of a gas turbine system of the present invention will now be described with reference to FIGS. 1 to 8. The gas turbine system of the present embodiment comprises a gas turbine 50, a combustor 10 for the gas turbine for supplying a combustion air to the gas turbine 50 and a compressor 55 for supplying a pressurized combustion air to the combustor 10.

Figure 2:
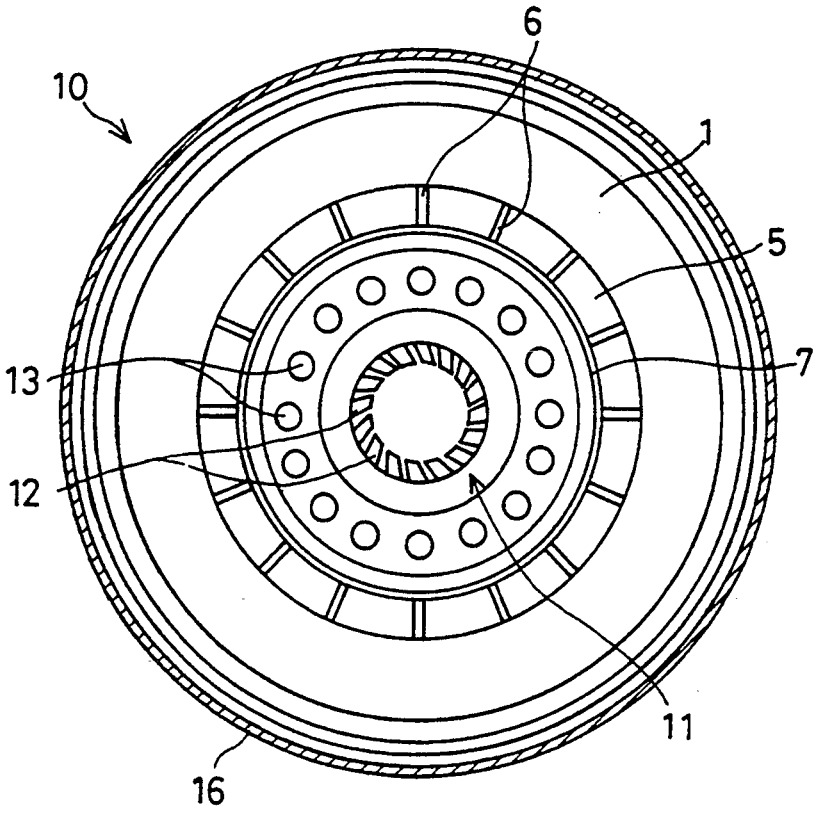
FIG. 2 is a sectional view as viewed in a direction of an arrow II in FIG. 1.
Figure 3:
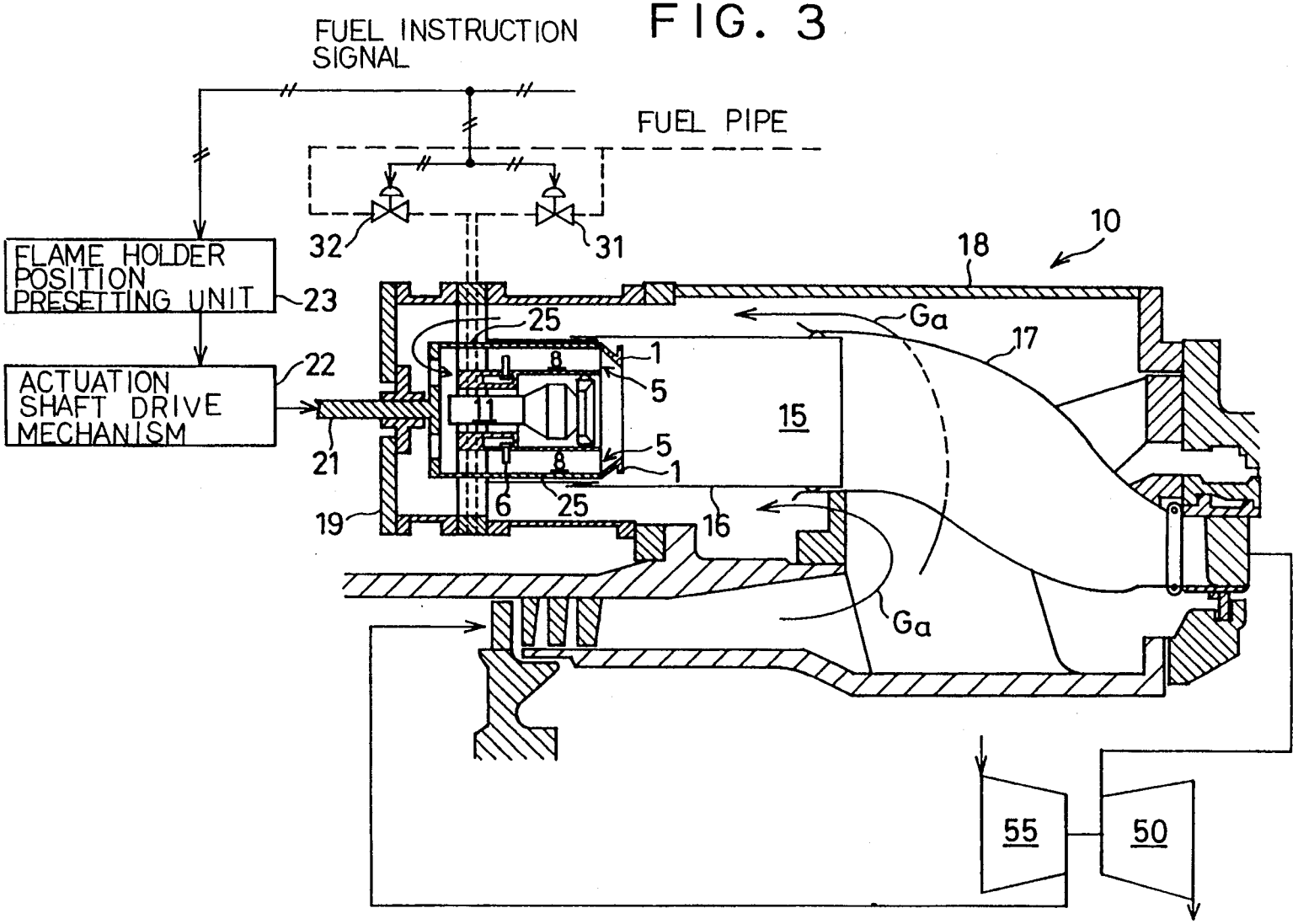
FIG. 3 is a sectional view and a block diagram showing a gas turbine system of the present invention using the gas turbine combustor of the first embodiment.

The combustor 10 comprises a combustor casing 18, a pilot burner 11, a premixed combustion nozzle 5 having an annular injection slot, a flame holder 1 provided downstream of the injection slot of the premixed combustion nozzle 5, an inner cylinder 16 which forms a combustion chamber 15 therein and a transition piece 17 for introducing a combusted gas formed in the combustion chamber 15 to the gas turbine 50 as shown in FIGS. 1 to 3.

An upstream end flange 19 which forms a part of the combustor casing 18 is provided with an actuating shaft 21 extending therethrough for moving the flame holder 1 in an axial direction of the combustor 10. The actuating shaft 21 is provided with an actuating shaft drive mechanism 22 for driving the actuating shaft 21 in an axial direction. The actuating shaft drive mechanism 22 is operated in accordance with an instruction from a flame holder position presetting unit 23 for presetting the position of the flame holder 1 in response to a fuel instruction signal.

The flame holder 1 is formed into an annular shape corresponding to the annular shape of the premixed combustion nozzle 5 as shown in FIG. 2. The flame holder 1 comprises a slanted plate 2 which extends from the outer peripheral edge of the injection slot of the premixed combustion nozzle 5 toward the center of the combustion chamber 15 and in a downstream direction and a flat plate 3 which extends from the downstream end of the slanted plate 2 in an outer radial direction substantially normal to the axial direction. The flame holder 1 is provided at the upstream end thereof with a link plate 25 which links the flame holder 1 with the actuating shaft 21. The link plate 25 also forms an outer peripheral wall of the premixed combustion nozzle 5. A plurality of premixed fuel injection nozzles 6 are provided in the premixed combustion nozzle 5.

The pilot burner 11 is provided substantially in the center of the annular premixed combustion nozzle 5. Pilot fuel injection nozzles 12 are provided in the vicinity of the center of the pilot burner 11. Air injection nozzles 13 for injecting combustion air are provided around the pilot fuel injection nozzles 12.

As shown in FIG. 3, the premixed fuel injection nozzles 6 and the pilot fuel injection nozzles 12 are connected with fuel flow rate adjusting valves 31 and 32 which change the valve opening in response to the fuel instruction signal, respectively.

In the present embodiment, means for changing the area of a passage comprises the link plate 25, the actuating shaft 21 and the actuating shaft drive mechanism 22. Means for controlling the passage area changing means comprises the flame holder position presetting unit 23.

Operation of the gas turbine system in the present embodiment will be described.

Figure 4:
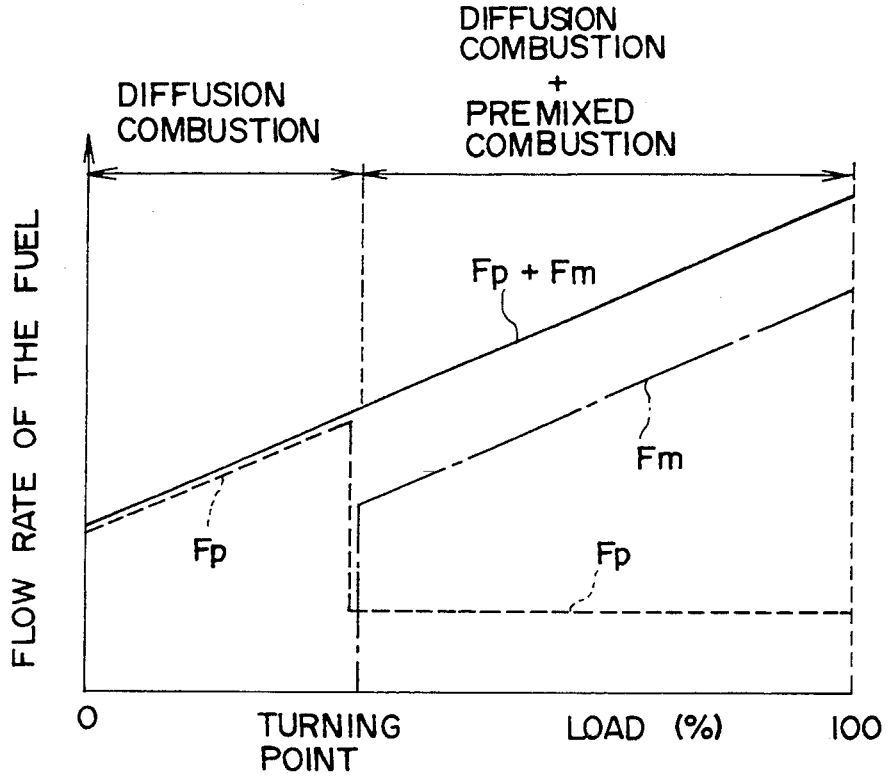
FIG. 4 is a graph showing the relationship between the load upon the combustor and the flow rate of the supplied fuel in the first embodiment of the present invention.

As shown in FIG. 4, when the combustor 10 is started, only the pilot fuel flow rate adjusting valve 32 is opened so that pilot fuel Fp is supplied to the pilot burner 11. Only diffusion combustion is carried out with the pilot burner 11 until the load upon the combustor becomes a given value. When the load upon the combustor reaches a given value, i.e. a turning point, the premixed fuel flow rate adjusting valve 31 is opened so that premixed combustion is also carried out. The rate of supply of the premixed fuel Fm is increased with the increase in the load upon the combustor and the ratio of the premixed combustion to the diffusion combustion increases after the turning point. On the other hand, the flow rate of the pilot fuel Fp supplied to the pilot burner 11 is immediately decreased when the load upon the combustor reaches the turning point. The flow rate of the pilot fuel does not change even if the load upon the combustor increases after the turning point.

Movement of the flame holder 1 associated with the change in the load upon the combustor and the combustion at this time will now be described with reference to FIGS. 5 to 8.

Figure 5:
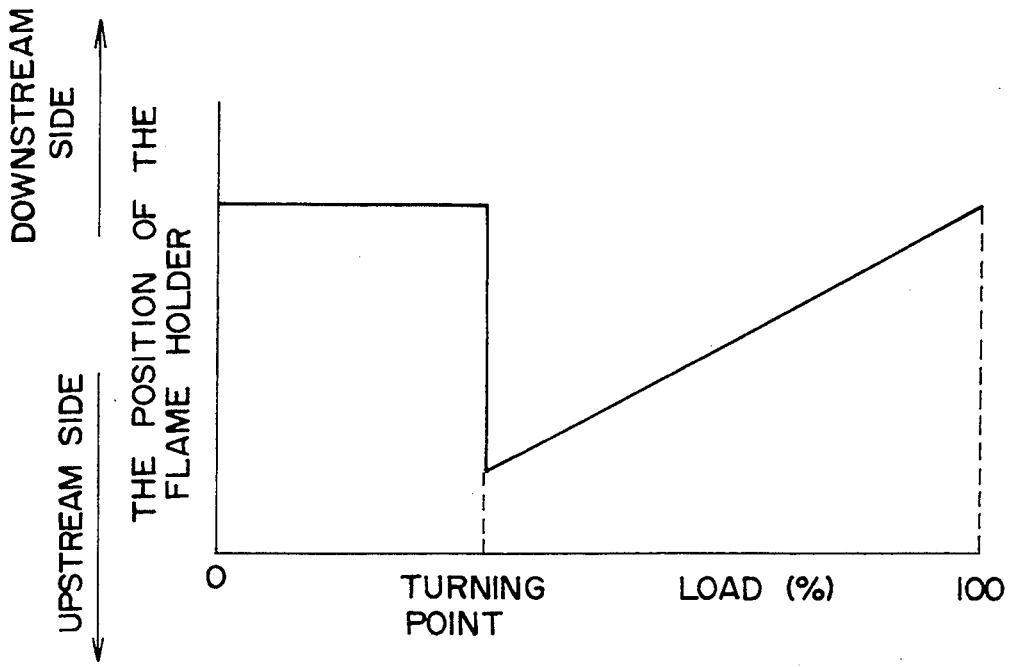
FIG. 5 is a graph showing the relationship between the load upon the combustor and the position of the flame holder in the first embodiment of the present invention.
Figure 6:
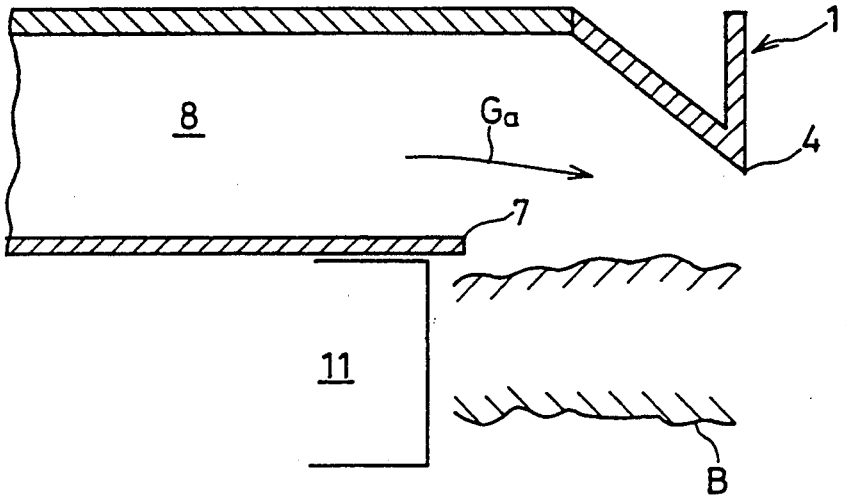
FIG. 6 is a sectional view of a main part of the combustor of the first embodiment of the present invention showing the positions of the flame holder when the combustor is started and when the load is emergently interrupted.
Figure 7:
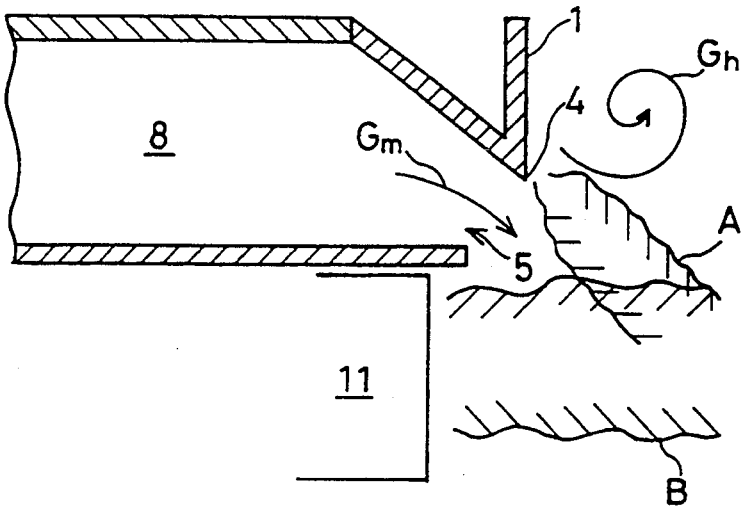
FIG. 7 is a sectional view of a main part of the combustor of the first embodiment of the present invention showing the position of the flame holder when the load upon the combustor is on a turning point.

The flame holder 1 is positioned at the most downstream side as shown in FIGS. 5 and 6 when only the diffusion combustion is performed as at the start. This causes the area of the passage for combustion air Ga between the outer peripheral edge 4 after the holder and the injection slot edge 7 of the premixed combustion nozzle 5 to become maximum. Thus, the flow speed of the combustion air Ga becomes very slow and the flow direction of the combustion air Ga becomes substantially the axial direction. Accordingly, stabilization of the diffusion combustion is achieved.

When the combustor load increases and reaches the turning point, the actuating shaft drive mechanism 22 is operated in accordance with an instruction from the flame holder position presetting unit 23 for moving the actuating shaft 21, the link plate 25 and the flame holder 1 to the most upstream side. At this time, the premixed fuel flow rate adjusting valve 31 is opened by the area corresponding to the load so that the premixed fuel Fm is injected into the premixed combustion nozzle 5. The premixed fuel Fm is mixed with the combustion air Ga in the premixing chamber 8 to form the premixed gas Gm, which will be injected from the injection slot and is burned to form a premixed flame A. A part of combusted gas Gh emitted from the premixed flame A constitutes a circulating flow downstream of the flame holder 1. The premixed gas Gm is fired by the hot combusted gas Gh to form a premixed flame A having a base portion at the peripheral edge 4 of the flame holder 1. Since the circulating flow of the hot combusted gas Gh is formed downstream of the flame holder 1 in such a manner, even the premixed gas Gm having a low fuel/air ratio is positively fired so that a stable premixed flame A can be obtained. Since the premixed gas Gm is injected in a direction toward the center of the combustor 10 so that the premixed flame A interferes with the diffusion flame B, further stabilization of the premixed flame A is achieved.

Figure 8:
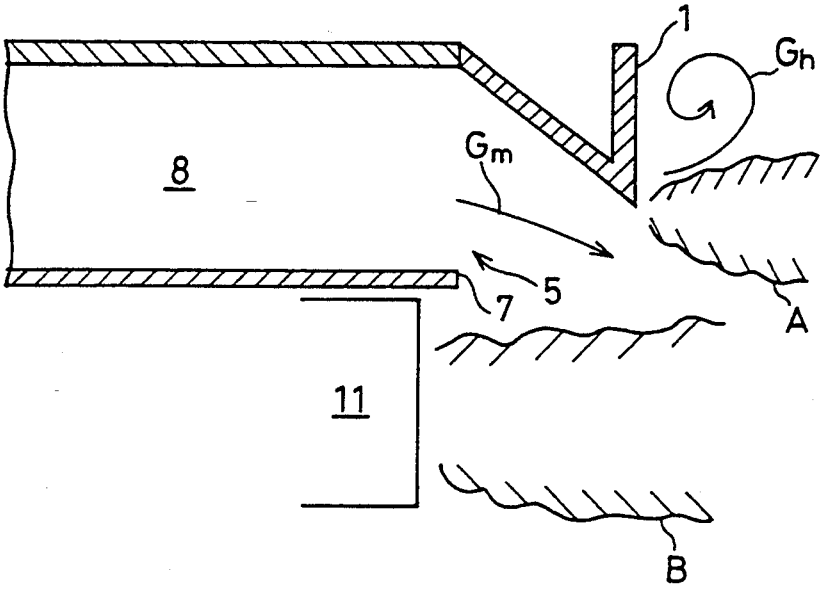
FIG. 8 is a sectional view of a main part of the combustor of the first embodiment of the present invention showing the position of the flame holder when the load upon the combustor is on a turning point.

As the load upon the combustor gradually increases, the flow rate of the combustion air Ga increases and the premixed fuel Fm also increases as mentioned above. In association with this, the flow rate of the premixed gas Gm increases. The flame holder 1 is gradually moved toward the downstream side in accordance with an instruction from the flame holder position presetting unit 23 as shown in FIGS. 5 and 8 in response to the increase in the load upon the combustor. Accordingly, the area of the passage between the peripheral edge 4 of the flame holder 1 and the injection slot edge 7 of the premixed combustion nozzle 5 increases and the flow speed of the premixed gas Gm is not so different from that when the load is approximate to the turning point. Since the injection direction of the premixed gas Gm changes from the direction toward the center to the direction toward the outer periphery, the interference of the premixed flame A with the diffusion flame B is mitigated.

On emergent interruption of the load, the flame holder 1 is moved to the most downstream side again as shown in FIG. 6. On this emergent interruption of the load, the premixed fuel Fm is generally turned off and only the pilot fuel Fp is supplied to perform only the diffusion combustion. Accordingly, the diffusion flame B is nearly unstable because of the abrupt change in flow rate. Since the flame holder 1 is positioned in the most upstream side, the combustion air Ga injected from the premixed combustion nozzle 5 is not directed toward the diffusion flame B. This prevents the diffusion flame B from being blown out by the combustion air Ga injected from the premixed combustion nozzle 5 so that stabilization of the diffusion flame B on the emergent interruption of the load is achieved.

Stable lean premixed combustion is enabled by the flame holder 1 in the present embodiment as mentioned above. Since the interference of the premixed flame A with the diffusion flame B is decreased with the increase in the load upon the combustor, reduction in NOx can be achieved.

Since the area of the passage increases with the increase in the flow rate of the premixed gas Gm, the flow speed of the premixed gas Gm can be caused to fall into a given range so that backfire and blowing out of a flame can be prevented.

Since in the present embodiment, the total area of the passage in the premixed combustion nozzle 5, i.e. in the premixed chamber 8 is not throttled and only the passage area at the injection slot of the premixed combustion nozzle 5 is throttled, pressure loss is relatively low so that the increase in the load imposed upon the compressor 55 can be suppressed.

Figure 9:
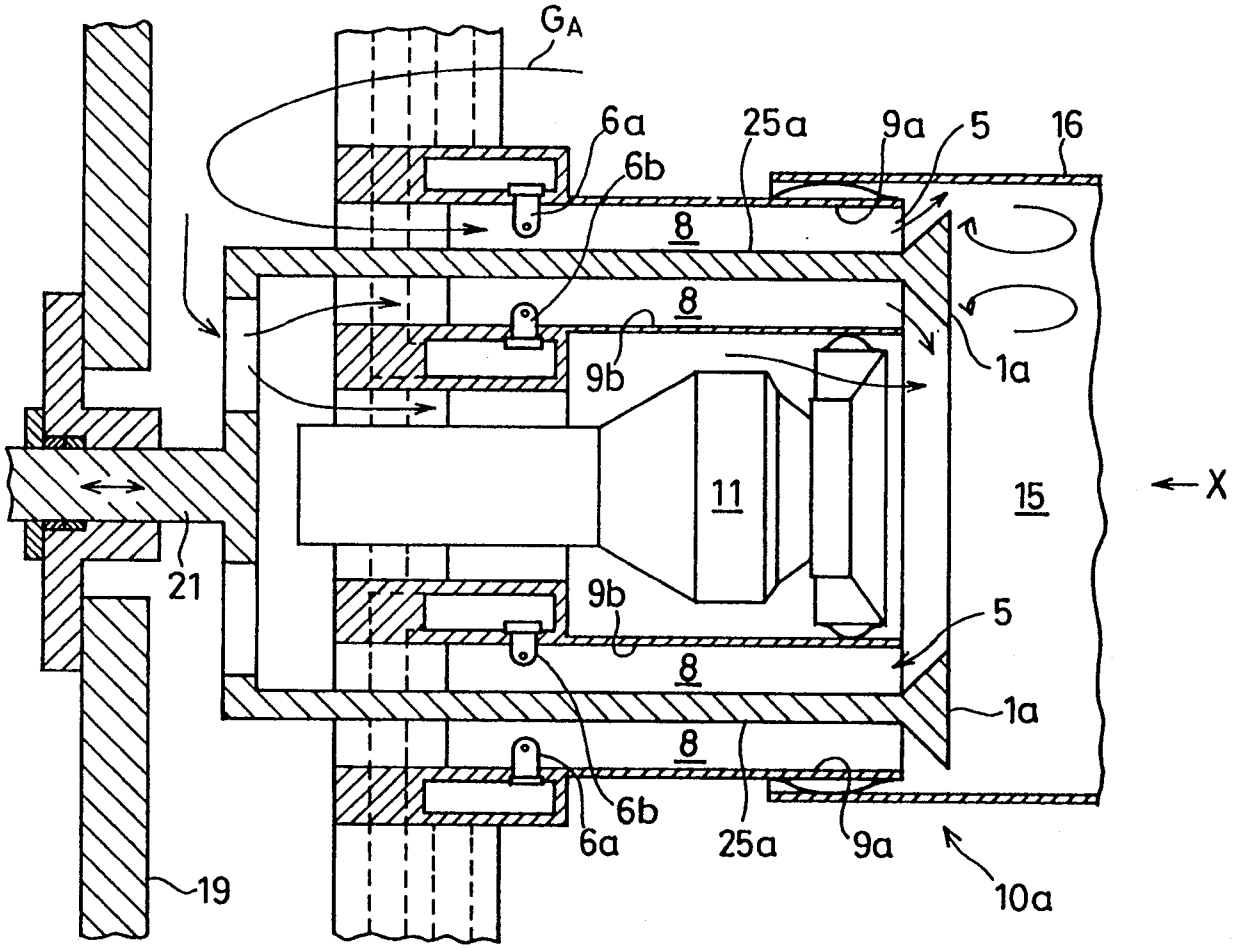
FIG. 9 is a sectional view showing a main part of a second embodiment of a gas turbine combustor of the present invention.
Figure 10:
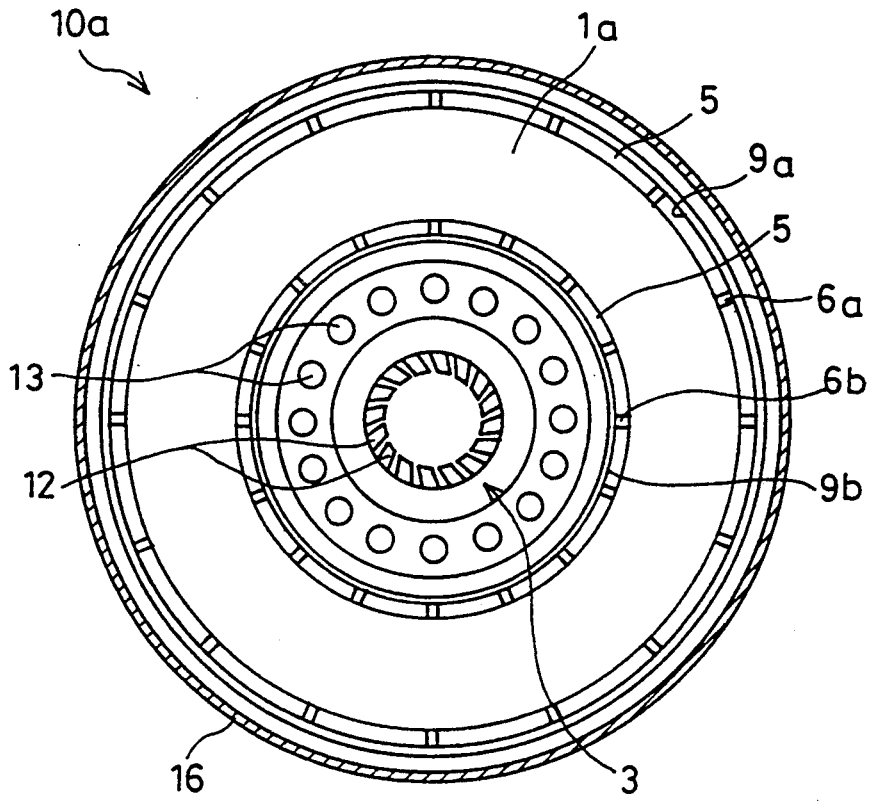
FIG. 10 is a sectional view as viewed in a direction of an arrow in FIG. 9.

A second embodiment of a gas turbine combustor of the present invention will be described with reference to FIGS. 9 and 10.

The structure of a gas turbine combustor **1O*a*** in the present embodiment is substantially identical with that in the first embodiment excepting that a flame holder of the second embodiment is different in shape and position from that in the first embodiment.

The flame holder **1*a* is formed into an annular shape corresponding to the annular premixed combustion nozzle 5 similarly to that in the first embodiment and has a section which is an equilateral triangle having an apex directed toward the upstream side. The flame holder 1*a* is supported by a link plate 25*a* so that it is positioned substantially on the midpoint between the outer peripheral wall 9*a* and the inner peripheral wall 9*b* of the premixed combustion nozzle 5**.

The same effects as those of the first embodiment can be obtained even if the combustor is formed in such a manner.

In order that the premixed fuel Fm is uniformly mixed with the combustion air Ga, it is necessary that the passage has a longer length than a certain length for its width in the premixing chamber 8. Therefore, if only the width Of the passage in the premixing chamber 8 is increased to increase the flow rate of the premixed gas Gm in the combustor 10 in the first embodiment, uniform mixing of the premixed fuel Fm with the combustion air Ga could not be achieved. Although the width of the passage of the premixing chamber 8 is substantially widened by dividing the premixing chamber 8 by the link plate **25*a*** into inner and outer chambers, the total width of the passage in the divided premixing chamber is not widened. Uniform mixing is thus achieved. Accordingly, increasing the flow rate of the premixed gas Gm, i.e. increasing the ratio of premixed combustion is possible in the present embodiment. Reduction in NOx can be achieved.

Figure 11:
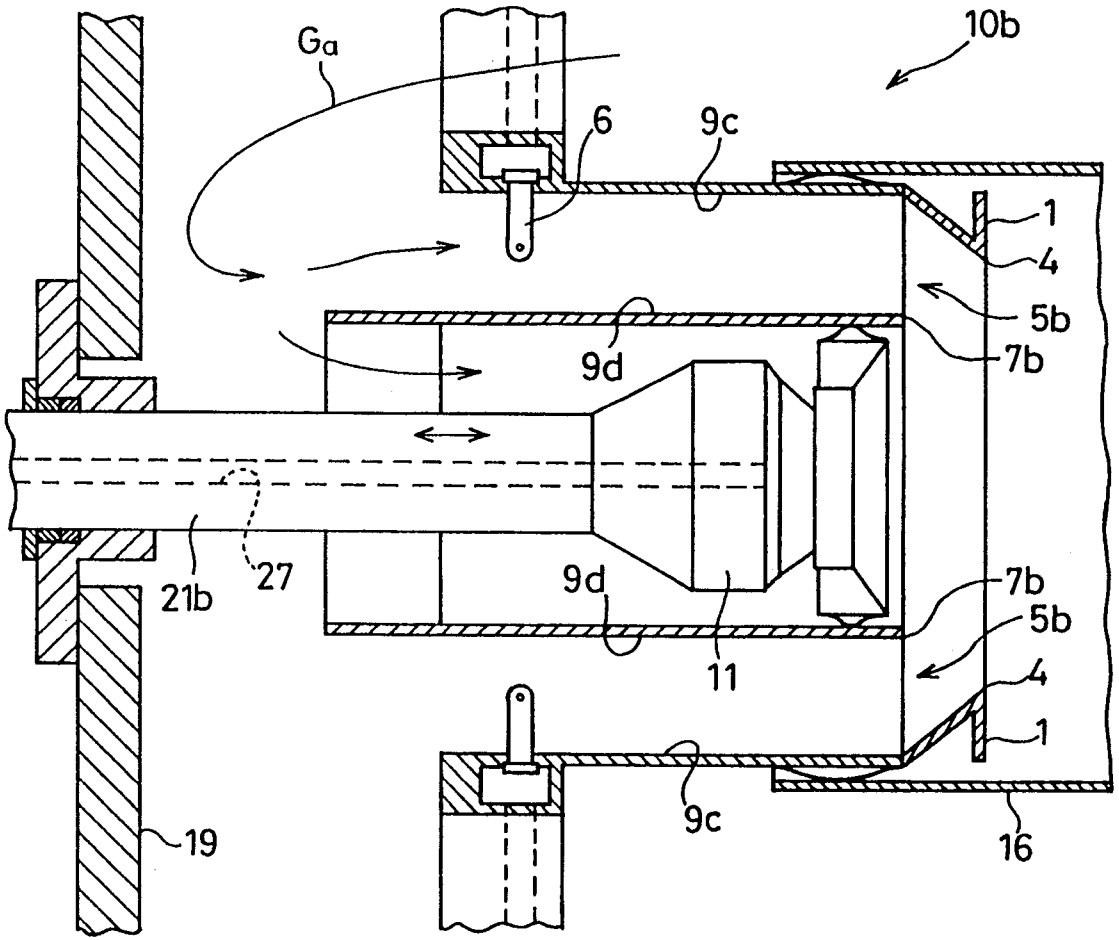
FIG. 11 is a sectional view showing a main part of a third embodiment of a gas turbine combustor of the present invention.

A third embodiment of a gas turbine combustor of the present invention will now be described with reference to FIG. 11.

Although the passage area between the injection slot edge 7 of the premixed combustion nozzle 5 and the peripheral edges of the flame holders 1, **1*a* is changed by moving the flame holder in the foregoing embodiment, the passage area is changed by moving the premixed combustion nozzle 5b in the present embodiment. The present embodiment is a modification in which the premixed combustion nozzle 5b** is modified in one sense.

A pilot burner 11 is mounted on an actuating shaft 21b which is movable in an axial direction as represented by a double headed arrow.

The actuating shaft 21b is formed with a fuel passage 27 therethrough for supplying pilot fuel Fp to the pilot burner 11. An inner peripheral wall 9d of the premixed combustion nozzle 5b is fixedly secured to the pilot burner 11 at the outer periphery of the pilot burner 11. The outer peripheral wall 9c of the premixed combustion nozzle 5b is secured to the inner cylinder 16 of the combustor and is provided with the flame holder 1 at the downstream end of the outer peripheral wall 9c thereof.

Movement of the actuating shaft 21b causes the inner peripheral wall 9d of the premixed combustion nozzle 5b together with the pilot burner 11 to move so that the passage area between the injection slot edge 7b of the premixed combustion nozzle 5b and the peripheral edge 4 of the flame holder 1 is changed. The same effects as those of the first embodiment can be obtained. Since the flame holder 1 is not moved in the present embodiment, the premixed flame having a base portion on the flame holder 1 is not moved. A cooling structure for the inner cylinder 16, etc. can be more simplified than that in the first embodiment.

Although the embodiments of the gas turbine combustors have been described, it is to be understood that the present invention is not limited to only these embodiments, but may be applied to other combustors such as a boiler in which premixed combustion is carried out.

A fourth embodiment in which the present invention is embodied as an boiler will now be described.

Figure 12:
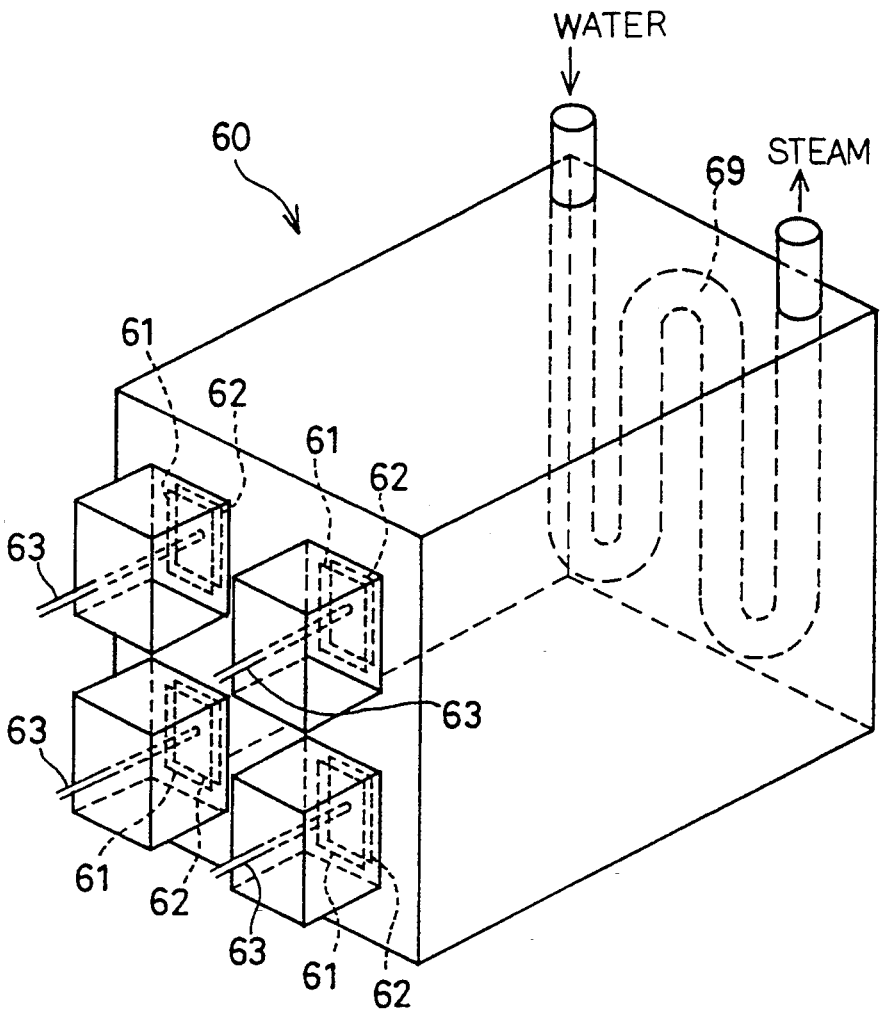
FIG. 12 is a perspective view showing a fourth embodiment of a boiler of the present invention.

The boiler 60 of the present embodiment comprises four premixed combustion nozzles 61, two for upper position and two for lower position as shown in FIG. 12. A steam pipe 69 is provided in a position facing each of the premixed combustion nozzles 61.

A flame holder 62 is provided in the vicinity of the injection slot of the premixed combustion nozzle 61. An actuating shaft 63 is mounted on the flame holder 62. The flame holder 62 can be moved by driving the actuating shaft 63 similarly to the first embodiment so that the passage area between the peripheral edge of the flame holder 62 and the injection slot edge of the premixed combustion nozzle 61 can be changed. Accordingly, the same effects as those in the first embodiment can be obtained in the present embodiment.

It is preferable that the boiler 60 be generally provided with upper and lower drive mechanisms for driving the actuating shafts 63 to change the operation manner of the upper and lower premixed combustion nozzles 61 depending upon the load, respectively.

Figure 13:
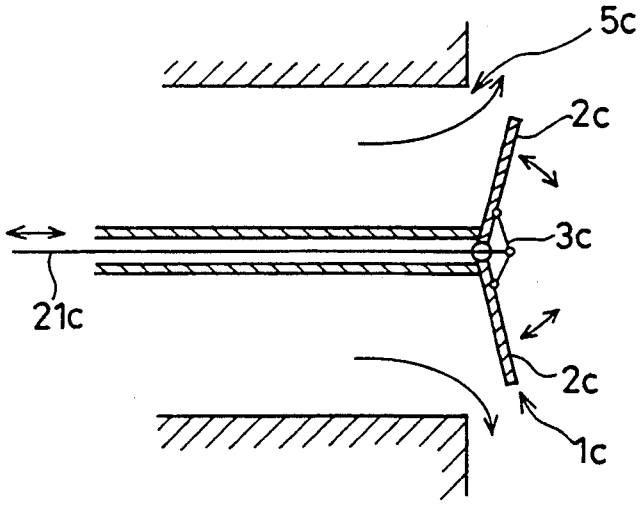
FIG. 13 is a sectional view showing a flame holder in one embodiment of the present invention.
Figure 14:
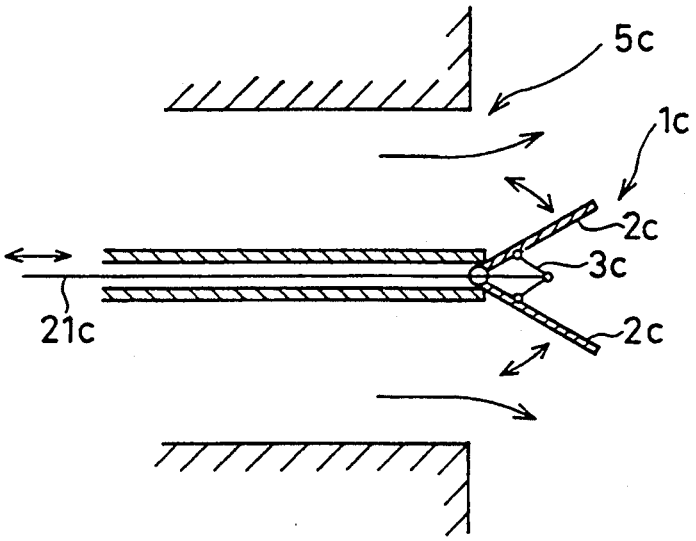
FIG. 14 is a sectional view showing a flame holder in a further embodiment of the present invention.

Although means for moving any one of the flame holder and the premixed combustion nozzle has been described as means for changing the passage area between the peripheral edge of the flame holder and the injection slot edge of the premixed combustion burner, the flame holder 1c may be modified as shown in FIGS. 13 and 14 for changing the passage area.

The flame holder 1c comprises two flat plates 2c. The flat plates 2c are hinged at the base portions thereof to form a four-link mechanism 3c, a part of which comprises the two flat plates 2c. An actuating shaft 21c is linked with a part of the four-link mechanism 3c so that the angle between the two flat plates 2c can be changed by driving the actuating shaft 21c.

Since the area of the flame holder 1 which opposes the flow of the premixed gas Gm can be changed by forming the flame holder as mentioned above, the passage area between the peripheral edge of the flame holder 1c and the injection slot edge of the premixed combustion burner 5c can be changed. Therefore, the same effects as those of the first embodiment can be obtained in the present embodiment.

Since only the passage area between the peripheral edge of the flame holder and the injection slot edge of the premixed combustion burner can be changed in accordance with the present invention, the increase in the load upon the compressor due to the increase in pressure loss can be suppressed and the flow speed of at the injection slot can be maintained substantially constant so that stable combustion can be achieved.

Since the direction of the injection of the premixed air can be changed, the interference of the diffusion flame with the premixed flame can be changed even if there is a diffusion flame at a predetermined plate. Since stabilization of the premixed flame can be achieved with the flame holder, lean premixed fuel combustion can be performed. Therefore, reduction in NOx can be achieved by decreasing the interference of the diffusion flame with the premixed flame and by carrying out the lean premixed fuel combustion.

What is claimed is:

1. A combustor comprising:

a combustion cylinder formed in a cylindrical form around a virtual combustor axis directed to a predetermined direction to have an interior space to be provided as a combustion chamber;

a diffusion combustion nozzle for injecting a fuel into said combustion chamber to form a diffusion flame;

a premixed combustion nozzle provided adjacent to said diffusion combustion nozzle, and having a passage extending in parallel to said virtual combustor axis for letting a premixed gas of a fuel and air pass therethrough, and an injection slot for injecting said premixed gas which has passed said passage into said combustion chamber in a direction parallel to said virtual combustor axis;

a flame holder formed in the vicinity of said injection slot of said premixed combustion nozzle and within said combustion chamber, and having a first slanted surface for directing said premixed gas from said premixed combustion nozzle toward a downstream side with respect to a direction in which said premixed gas is injected from said premixed combustion nozzle while directing said premixed gas towards said diffusion combustion nozzle and a second surface extending from a downstream edge of said first slanted surface in a direction substantially perpendicular to and away from said virtual combustor axis to form a circulating flow of a combustion gas generated as a result of the combustion of said premixed gas; and a passage area changing mechanism for moving at least one of said premixed combustion nozzle and said flame holder relative to each other in the direction parallel to said virtual combustor axis to change the passage area between said injection slot of said premixed combustion nozzle and said downstream edge of the first slanted surface of said flame holder through which said premixed gas passes.

2. A combustor comprising:

a combustion cylinder formed in a cylindrical form around a virtual combustor axis directed to a predetermined direction, to have an interior space to be provided as a combustion chamber;

a diffusion combustion nozzle for injecting a fuel into said combustion chamber to form a diffusion flame;

a premixed combustion nozzle provided adjacent to said diffusion combustion nozzle, and having a passage extending in parallel to said virtual combustor axis for letting a premixed gas fuel and air pass therethrough, and an injection slot for injecting said premixed gas which has passed said passage into said combustion chamber in a direction parallel to said virtual combustor axis;

a premixed fuel injection nozzle which injects a fuel which comprises premixed gas into said passage of said premixed combustion nozzle;

a premixed fuel flow rate adjusting means which adjusts the flow rate of the fuel supplied to said premixed fuel injection nozzle;

a flame holder formed in the vicinity of said injection slot of said premixed combustion nozzle and within said combustion chamber, and having a first slanted surface for directing said premixed gas from said premixed combustion nozzle toward a downstream side with respect to a direction in which said premixed gas is injected from said premixed combustion nozzle while directing said premixed gas towards said diffusion combustion nozzle, and a second surface extending from a downstream edge of said slanted surface in a direction substantially perpendicular to and away from said virtual combustor axis to form a circulating flow of a combustion gas generated as a result of the combustion of said premixed gas;

a passage area changing mechanism for moving at least one of said premixed combustion nozzle and said flame holder relative to each other in the direction parallel to said virtual combustor axis to change the passage area between said injection slot of said premixed combustion nozzle and said downstream edge of the slanted surface of said flame holder through which said premixed gas passes; and a change controlling means which gives instructions to said passage area changing mechanism to change a relative movement amount of at least one of said premixed combustion nozzle and said flame holder, so that said passage area becomes larger as the fuel is increased when at least the fuel of said premixed gas is increased by said premixed fuel adjusting means.

3. A combustor as defined in claim 2 in which said diffusion combustion nozzle is provided on said virtual combustor axis as a pilot burner and said injection slot of said premixed combustion nozzle is formed in an annular shape around said virtual combustor axis.

4. A gas turbine system, comprising a combustor as defined in claim 3 and a gas turbine to which the combustion gas generated in said combustor is supplied.

5. A gas turbine system, comprising a combustor as defined in claim 2 and a gas turbine to which the combusted gas generated in said combustor is supplied.

* * * * *